US008491403B2

(12) United States Patent
Schreibfeder

(10) Patent No.: US 8,491,403 B2
(45) Date of Patent: Jul. 23, 2013

(54) AMUSEMENT RIDE SYSTEM

(75) Inventor: Nathan Schreibfeder, Lancaster, CA (US)

(73) Assignee: Nathan Schreibfeder, Palmdale, CA (US)

( * ) Notice: Subject to any disclaimer, the term of this patent is extended or adjusted under 35 U.S.C. 154(b) by 272 days.

(21) Appl. No.: 13/179,317

(22) Filed: Jul. 8, 2011

(65) Prior Publication Data

US 2013/0012327 A1 Jan. 10, 2013

(51) Int. Cl.
*A63G 31/16* (2006.01)
*A63G 1/44* (2006.01)

(52) U.S. Cl.
USPC ..... 472/130; 472/2; 472/60; 472/131

(58) Field of Classification Search
USPC .. 472/2, 42, 50, 59, 60, 61, 130, 131; 104/53, 104/124, 125
See application file for complete search history.

(56) References Cited

U.S. PATENT DOCUMENTS

| | | | | |
|---|---|---|---|---|
| 2,221,215 | A * | 11/1940 | Eyerly | 472/50 |
| 5,957,779 | A * | 9/1999 | Larson | 472/34 |
| 6,315,674 | B1 * | 11/2001 | Slade et al. | 472/131 |
| 6,755,749 | B2 * | 6/2004 | Stengel | 472/50 |
| 8,066,576 | B2 * | 11/2011 | Threlkel | 472/47 |

* cited by examiner

*Primary Examiner* — Kien Nguyen

(57) ABSTRACT

An amusement ride system combines about six or more different ride elements from different types of amusement rides available to the public today into a single design. The amusement ride system may bring customers back time and time again for a new ride experience on the same ride design. This may allow amusement ride operators to provide varying ride experiences without requiring a completely different ride, thus saving cost and space. The amusement ride system may include a plurality of pods adapted to house riders. The pods may be adapted to move up and down, spin about a central tower, and spin and swivel about the pod's axes.

15 Claims, 4 Drawing Sheets

AMUSEMENT RIDE SYSTEM

BACKGROUND OF THE INVENTION

The present invention relates to an amusement ride system and, more particularly, to a universal amusement ride system that provides a full environmental immersion visually and, seemingly, physically.

Current amusement ride systems lack the elements and the movements needed to offer a truly amazing ride experience. Current virtual reality rides lack critical movements to make the experience feel real. This lack of movement causes dizziness, nausea, and tries to trick your mind into thinking it is real.

Current amusement rides, such as roller coasters, cannot change once built. These rides may be expensive to build and may consume a large footprint. Riders may get bored with the same experience with each ride. To change the experience, the ride operator would have to demolish the structure or have major reconstruction completed. A limited number of these large footprint rides may be provided on a site. To provide the rider with the opportunity to experience several different types of amusement rides, the amusement operator would be required to dedicate large areas of land for this purpose.

As can be seen, there is a need for an amusement ride that may provide a varied experience for riders in a single structure.

SUMMARY OF THE INVENTION

In one aspect of the present invention, a ride system comprises a tower; and a plurality of pods disposed about a pod support ring, the pod support ring circumscribing the tower, wherein the pod support ring is adapted to slide up and down the tower; the pod support ring is adapted to spin about the tower; and the plurality of pods are adapted to spin and swivel.

In another aspect of the present invention, a amusement ride system comprises a tower; a plurality of tracks extending along a length of the tower; a track ring circumscribing the track, wherein a portion of the track ring extends into the plurality of tracks; and the track ring is adapted to slide up and down the tower; and a plurality of pods disposed about a pod support ring, the pod support ring circumscribing the track ring, wherein the pod support ring is adapted to spin about the tower; and the plurality of pods are adapted to spin and swivel inside a plurality of pod brackets attached to the pod support ring.

These and other features, aspects and advantages of the present invention will become better understood with reference to the following drawings, description and claims.

DETAILED DESCRIPTION OF THE INVENTION

Figure 1:
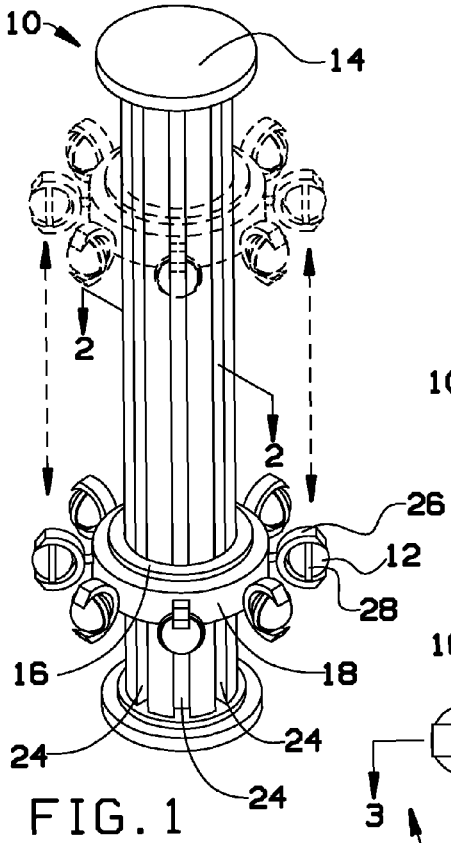
FIG. 1 is a perspective view of an amusement ride system according to an exemplary embodiment of the present invention.
Figure 2:
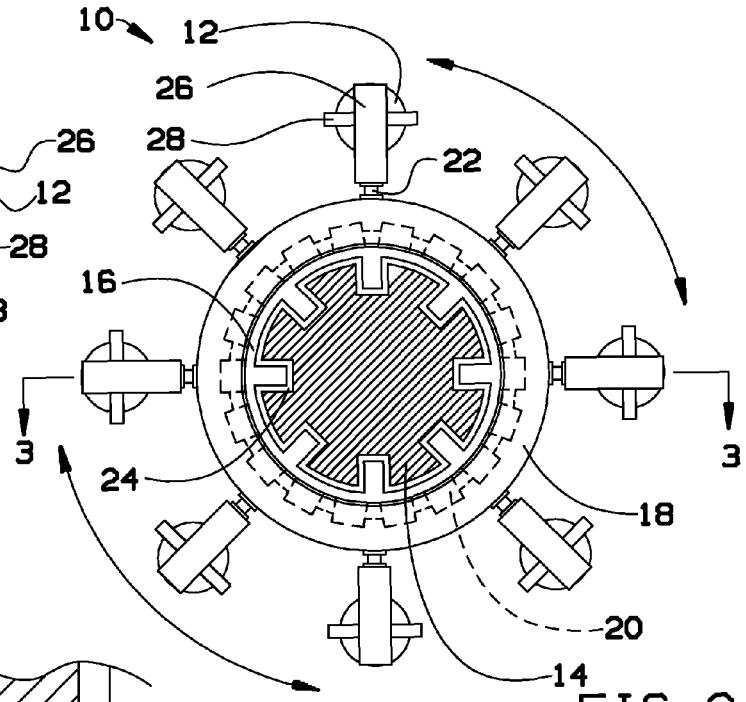
FIG. 2 is a section view of the amusement ride system taken along line 2-2 of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides an amusement ride system that combines about six or more different ride elements from different types of amusement rides available to the public today into a single design. The amusement ride system may bring customers back time and time again for a new ride experience on the same ride design. The amusement ride system may include a plurality of pods adapted to house riders. The pods may be adapted to move up and down, spin about a central tower, and spin and swivel about the pod's axes.

Referring now to FIGS. 1 through 10, an amusement ride system 10 may include a plurality of pods 12 adapted to move relative to a tower 14. The pods 12 may hold, for example, two to four riders 30, while larger or smaller designs may be contemplated within the scope of the present invention. The riders 30 may be seated, standing, or some other rider placement during the ride. A safety harness 36 may secure the rider 30 to, for example, a seat 38. The riders 30 may experience a full range of motion while participating in the ride, including g-force effects and gravity effects. The riders 30 may experience a falling/rising feeling, pivoting left and right, rotating side to side and the sensation of acceleration/deceleration, accompanied by visual and audible stimuli.

Figure 3:
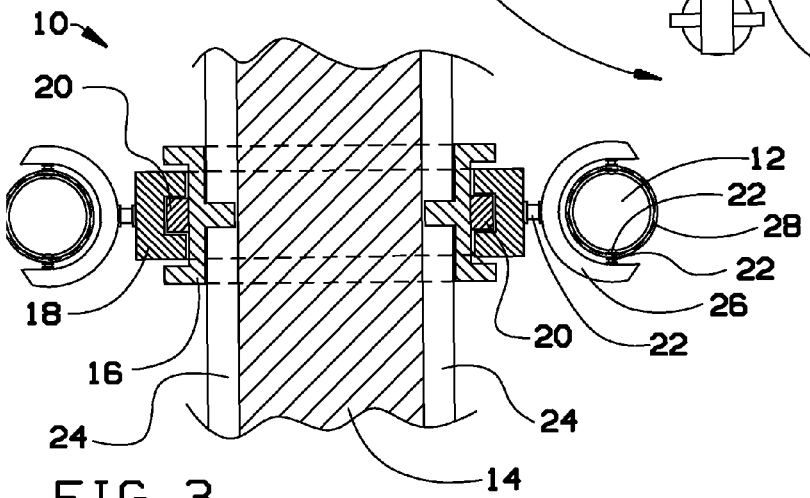
FIG. 3 is a section view of the amusement ride system taken along line 3-3 of FIG. 2.
Figure 4:
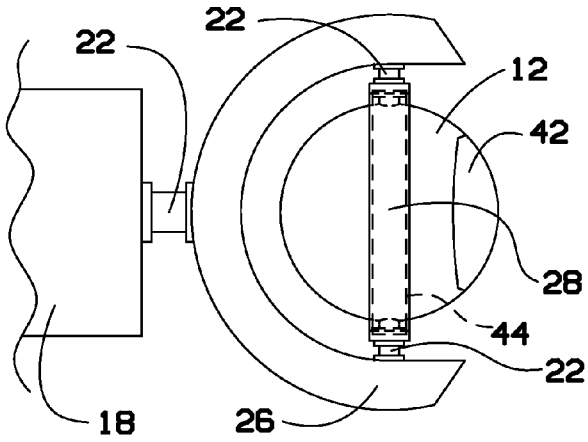
FIG. 4 is a side detail view of a pod of the amusement ride system of FIG. 1.
Figure 5:
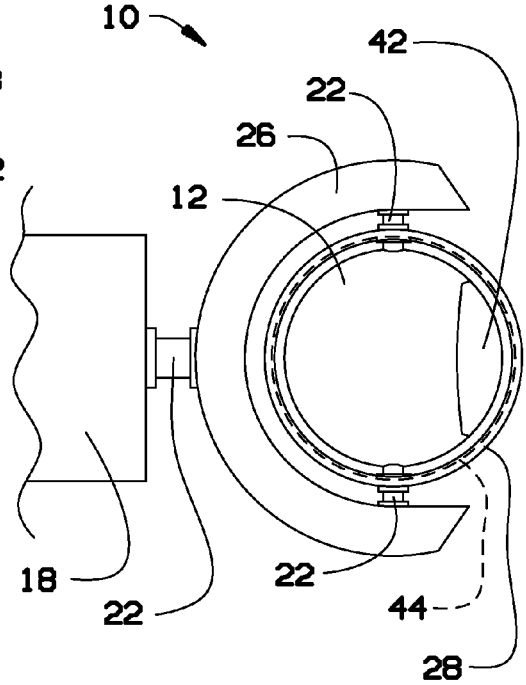
FIG. 5 is another side detail view of the pod of the amusement ride system of FIG. 1.
Figure 6:
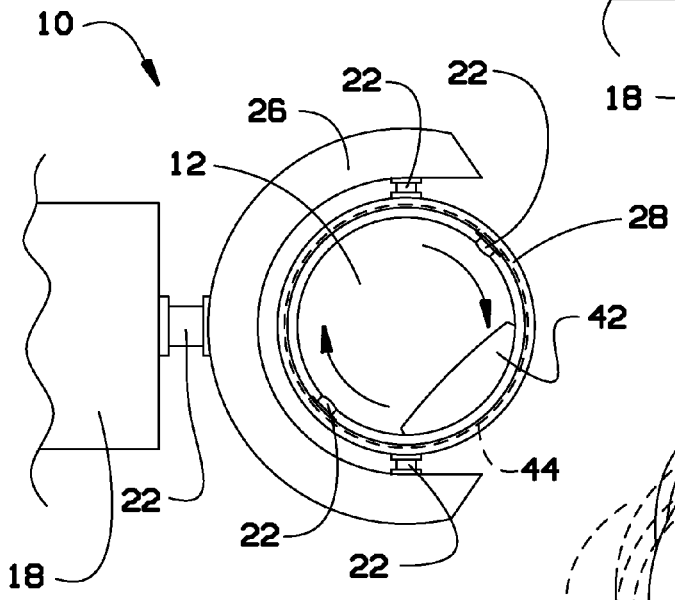
FIG. 6 is a side detail view of the pod of the amusement ride system of FIG. 1, showing rotation of the pod.
Figure 7:
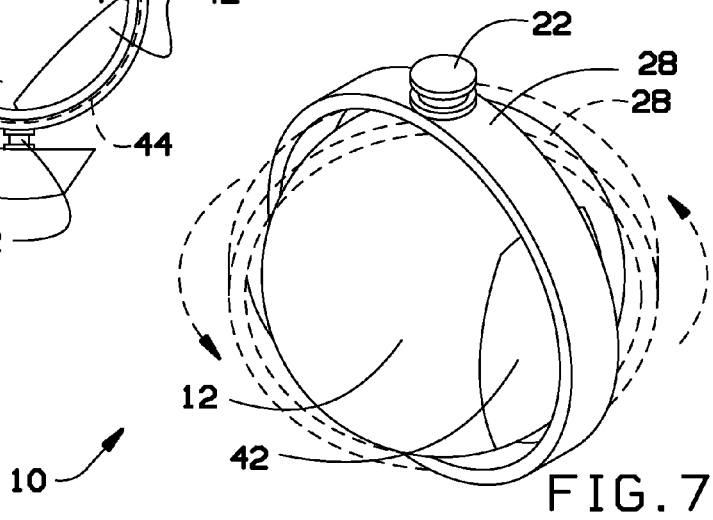
FIG. 7 is a perspective view of the pod of the amusement ride system of FIG. 1, showing rotation of the pod about a pod track ring.
Figure 8:
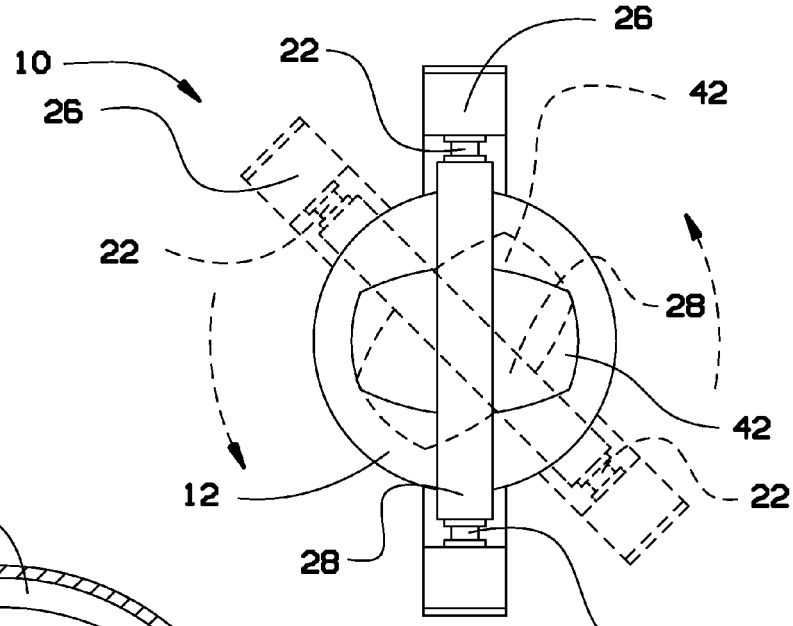
FIG. 8 is a front view of the pod of the amusement ride system of FIG. 1, showing rotation of the pod about a swivel joint.

The tower 14 may, for example, include a generally round section along which the pods 12 may travel. The tower 14 may be from about 10 feet to several hundred feet high. Support structures (not shown) may help support the tower 14. A plurality of tracks 24 may be formed in the tower 14. A track ring 16 may have a rectangular C-shaped cross-section, as shown in FIG. 3, with an arm adapted to fit into the tracks 24 of the tower 14. The track ring 16 may be configured to move up and down the tower 14. A magnetic track 20 may be disposed about the track ring 16. A pod support ring 18 may be configured to rotate about the magnetic track 20. As the pod support ring 18 rotates, the pods 12 also rotate, where centrifugal force creates a g-force effect on the rider 30 inside the pod 12. A swivel 14 may be used to attach a pod bracket 26 to the pod support ring 18. The swivel 14 may permit the pod support ring 18 to rotate relative to the pod support ring 18.

The pod bracket 26 may be generally C-shaped, where the pod 12 may fit inside the C-shaped pod bracket 26. First and second pod swivels 22 may be disposed to secure the pod 12 at opposite ends thereof to form an imaginary axis through the pod 12. The first and second pod swivels 22 may permit the pod 12 to rotate about the imaginary axis. A pod track ring 28 may be disposed about a circumference of the pod 12. The pod track ring 28 may permit the pod 12 to rotate inside the pod bracket 26 along a pod track 44. The pod track ring 28 may provide the sensation of the pod 12 tipping from side to side (see FIG. 4) or forward and back (see FIGS. 5 and 6), depending on the rotation of the pod 12 about the pod swivels 22. The pod swivels 22 may provide the sensation of the pod 12 spinning.

Figure 9:
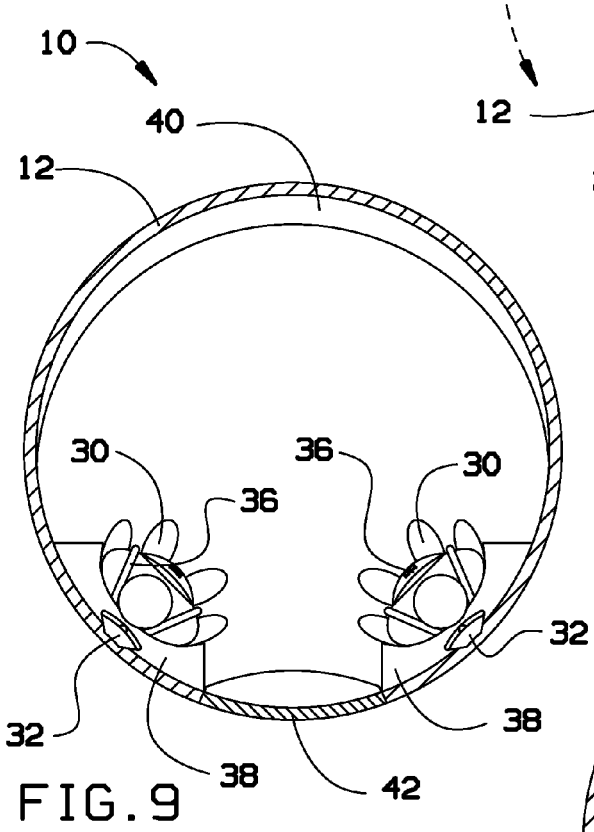
FIG. 9 is a top view showing riders disposed inside the pod of the amusement ride system of FIG. 1.
Figure 10:
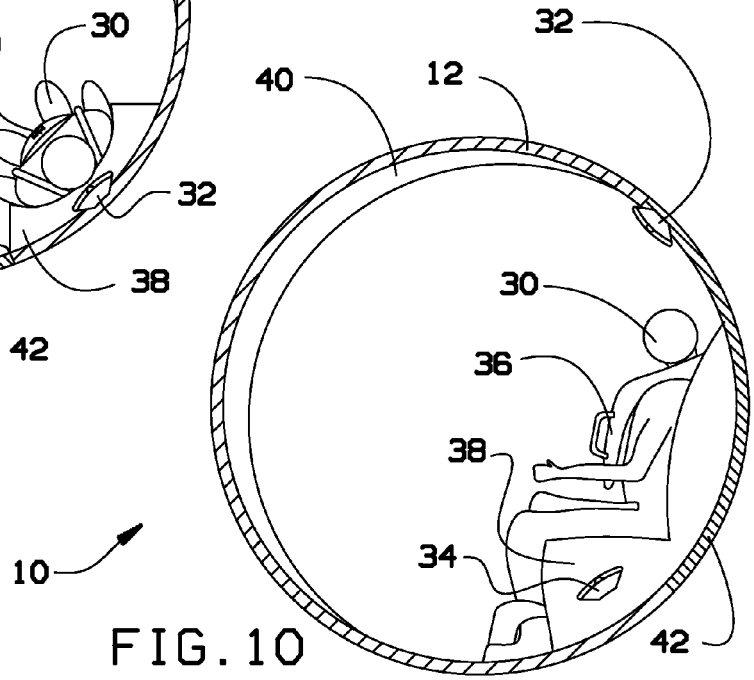
FIG. 10 is a side view showing a rider disposed inside the pod of the amusement ride system of FIG. 1.

Referring to FIGS. 9 and 10, a door 42 may be disposed in the pod 12 to permit riders 30 to enter and exit the pod 12. Speakers 32 may be disposed inside the pod 12, typically surrounding each seat 38, to provide the rider 30 with a surround sound type of effect. A subwoofer 34 may be disposed, typically in each seat 38, to provide deep bass sounds and vibrations to the riders 30. A screen 40 may be provided opposite the seats 38. The screen 40 may be disposed completely inside the pod or may be disposed outside the pod and visible through one or more cut aways, such as windows, made in the pod 12. The screen 40 may cover some or all of the rider's field of view when positioned in the seats 38. Such a screen 40 may provide visual stimuli for the rider. For example, the speakers 32 and screen 40 may be configured to show the sounds and sights of a roller coaster ride. The amusement ride system 10 may move the pod 12 to simulate the movements experienced during a roller coaster ride. The pods 12 may move up and down, spin, rotate and swivel to provide a roller coaster ride physical effect. Wind effects may be added inside the pod 12 via one or more fans (not shown). The fans may provide a heated, cooled or unconditioned air flow to the riders 30. The screen 40 may be a three-dimensional screen. The riders 30 may or may not be required to wear three-dimensional glasses to achieve a 3-D effect. The visual images on the screen 40, the audio sounds played, the movements of the pods 12, the operation of the fans, and the like, may be computer controlled. A computer console (not shown) may be provided to a ride operator to select one of several ride programs, for example, a roller coaster ride program, to run for each ride.

Figure 11:
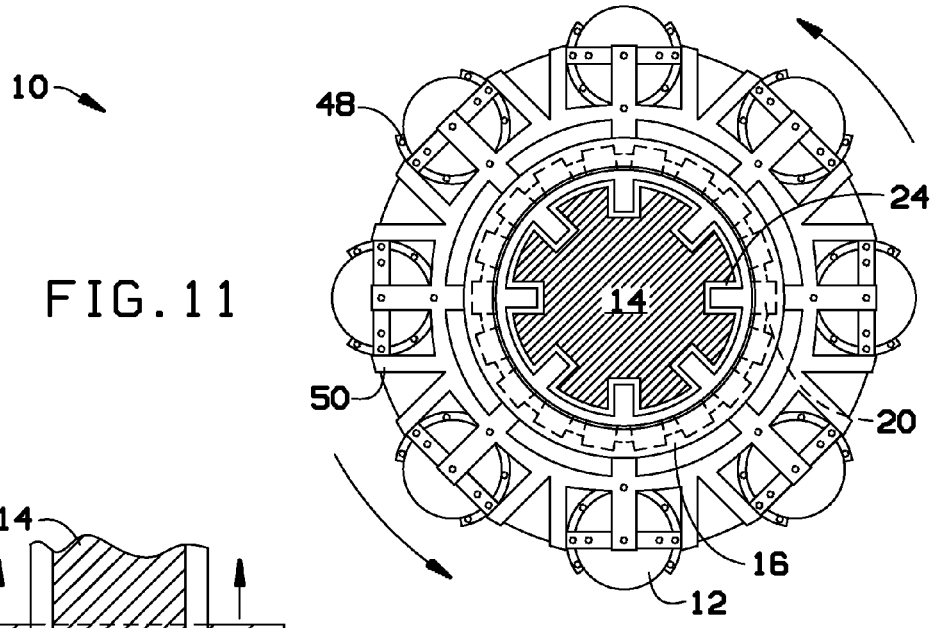
FIG. 11 is a top section view of an amusement ride system according to an alternate embodiment of the present invention.
Figure 12:
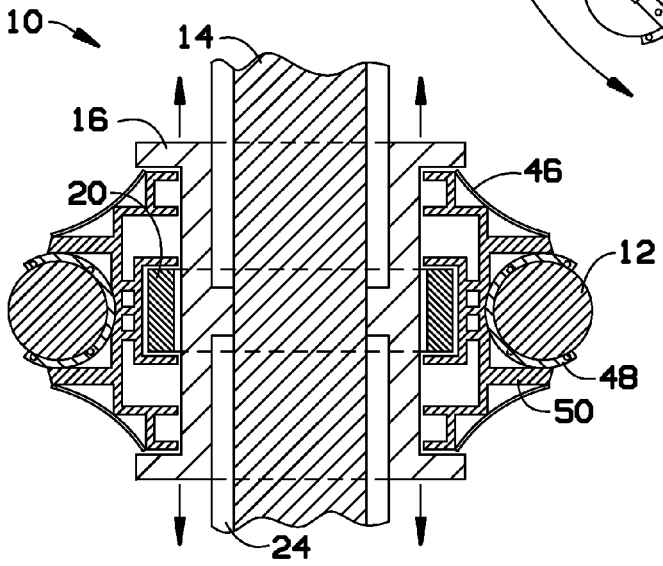
FIG. 12 is a side section view of the amusement ride system of FIG. 11.
Figure 13:
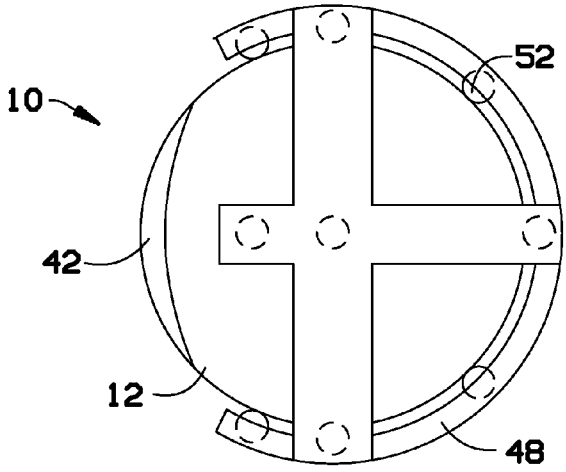
FIG. 13 is a detail view of a pod of the amusement ride system of FIG. 11.

Referring now to FIGS. 11 through 13, different configurations for the pod support skeleton structure may be possible. For example, a pod support skeleton enclosure 46 may enclose a rotating pod support skeleton 50. The rotating pod support skeleton 50 may support a pod enclosure 48. The pod enclosure 48 may rotatably hold the pod 12. A plurality of ball-bearings 52 may be disposed between the pod enclosure 48 and the pod 12.

Other mechanisms for holding the pods 12 may be contemplated and be within the scope of the present invention, provided that the pods 12 may be configured to spin about the tower 14, rotate about its axis, swivel and spin.

The pods 12 may be relatively sound proof and, once inside, the riders 30 may have no view of the outside of the pod 12. Such a configuration may permit a rider's visual and audible senses to be engulfed by the screen 40 and the speakers 32.

The rider's experience may not be limited to only typical amusement rides, such as roller coasters. Other rides may be available, including, for example, virtual reality type of rides, where the rider may, for example, riding in a space ship, a race car, a stunt motorcycle, or the like.

Movements (up and down, spinning, rotating and swiveling) may be achieved through various means. For example, hydraulics, magnets, gears, electric motors, robotics and a specialized treadmill design can be used for certain movements. Typically, magnets may make certain movements smoother for the riders. Solar power or wind power, along with appropriate power storage devices, may be used to provide some or all of the power for the amusement ride system 10.

The amusement ride system 10 may be used for a variety of purposes. For example, the amusement ride system 10 may be used as an amusement ride, an arcade game/ride, a flight simulator, a scenario simulator, an interactive/educational game or ride, an elevator system, a virtual reality system, or the like. The amusement ride system 10 may be located in, for example, amusement parks, carnivals, fairs, zoos, museums, observatories, malls, movie theaters, specially designed parks, and the like.

It should be understood, of course, that the foregoing relates to exemplary embodiments of the invention and that modifications may be made without departing from the spirit and scope of the invention as set forth in the following claims.

What is claimed is:

1. A ride system comprising:

a tower; and a plurality of pods disposed about a pod support ring, the pod support ring circumscribing the tower, wherein the pod support ring is adapted to slide up and down the tower;

the pod support ring is adapted to spin about the tower; and the plurality of pods are adapted to spin and swivel.

2. The ride system of claim 1, further comprising a plurality of tracks extending along a length of the tower.

3. The ride system of claim 2, further comprising a track ring circumscribing the track, wherein:

a portion of the track ring extends into the plurality of tracks; and the track ring is adapted to slide up and down the tower.

4. The ride system of claim 3, further comprising a magnetic track formed about the track ring.

5. The ride system of claim 4, wherein the pod support ring is disposed to rotate about the magnetic track.

6. The ride system of claim 1, further comprising a plurality of pod bracket attached to the pod support ring, each of the pod brackets adapted to contain one of the plurality of pods, each of the pod brackets adapted to rotate relative to the pod support ring.

7. The ride system of claim 6, further comprising first and second pod swivels adapted to secure opposite sides of the pod inside the pod bracket, wherein the pod is configured to spin about an axis formed between the first and second pod swivels.

8. The ride system of claim 7, further comprising a pod track ring circumscribing the pod, wherein the pod is configured to swivel along the pod track ring.

9. The ride system of claim 1, further comprising one or more seats disposed in each of the plurality of pods, the seats adapted to contain a rider therewithin.

10. The ride system of claim 1, further comprising one or more speakers disposed inside each of the plurality of pods.

11. The ride system of claim 1, further comprising a subwoofer disposed inside each of the plurality of pods.

12. The ride system of claim 1, further comprising a screen disposed inside each of the plurality of pods.

13. The ride system of claim 1, further comprising a door configured to provide entry and exit to and from the pod.

14. An amusement ride system comprising:

a tower;

a plurality of tracks extending along a length of the tower;

a track ring circumscribing the track, wherein a portion of the track ring extends into the plurality of tracks; and the track ring is adapted to slide up and down the tower; and a plurality of pods disposed about a pod support ring, the pod support ring circumscribing the track ring, wherein the pod support ring is adapted to spin about the tower; and the plurality of pods are adapted to spin and swivel inside a plurality of pod brackets attached to the pod support ring.

15. The amusement ride of claim 14, further comprising:

one or more seats disposed in each of the plurality of pods, the seats adapted to contain a rider therewithin;

one or more speakers disposed inside each of the plurality of pods;

a subwoofer disposed inside each of the plurality of pods;

a screen disposed inside each of the plurality of pods; and a door configured to provide entry and exit to and from the pod.

* * * * *